United States Patent [19]

Bristow

[11] 4,406,654

[45] Sep. 27, 1983

[54] ADJUSTABLE FEEDING DEVICE FOR THE ADMINISTRATION OF DOSAGES OF GELS AND PASTES TO FARM ANIMALS

[75] Inventor: Robert L. Bristow, Titusville, N.J.

[73] Assignee: American Cyanamid Company, Stamford, Conn.

[21] Appl. No.: 351,066

[22] Filed: Feb. 22, 1982

[51] Int. Cl.[3] ..... A61D 7/00

[52] U.S. Cl. ..... 604/209

[58] Field of Search ..... 128/223, 224, 236, 234, 128/218 C, 215; 222/309, 391

[56] References Cited

U.S. PATENT DOCUMENTS

| | | | |
|---|---|---|---|
| 3,504,673 | 4/1970 | Parisi | 222/309 |
| 4,090,639 | 5/1978 | Campbell et al. | 128/218 C X |
| 4,185,755 | 1/1980 | Sachs et al. | 222/309 X |

*Primary Examiner*—John D. Yasko

*Attorney, Agent, or Firm*—Thomas J. Monahan

[57] ABSTRACT

Animal-feeding device which accepts cartridges containing various gels, pastes, or other similar materials. This device is useful for the oral administration of feeds or medicants to farm animals, especially cattle, in adjustable dosages to fit the individualized needs of animals under treatment.

5 Claims, 2 Drawing Figures

Figure 1:
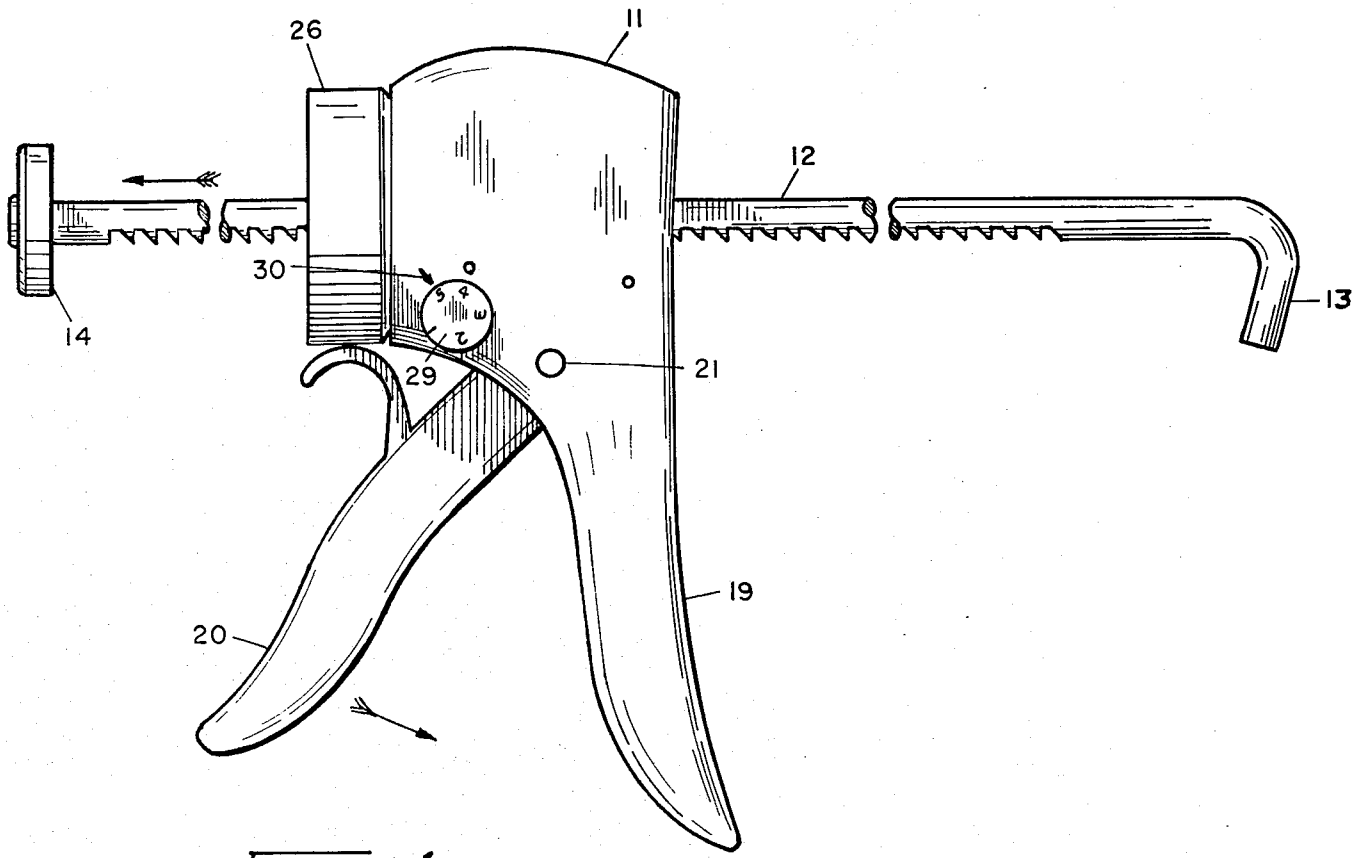

ADJUSTABLE FEEDING DEVICE FOR THE ADMINISTRATION OF DOSAGES OF GELS AND PASTES TO FARM ANIMALS

The invention herein described relates to a new apparatus for easily feeding animals measured oral doses of various gels, pastes or other similar preparation. Such feeds may be medicated. This apparatus uses an adjustable regulator for accurately modifying feed doses to farm animals, especially cattle, in order to meet the individualized requirements of animals under treatment.

By way of background, various feed compositions which can be utilized in the presently-described device (i.e., medicated gels and/or pastes) are known in the art. For example, a particularly well-suited gel is disclosed in U.S. Pat. No. 4,287,176 (1981). Various drugs and medications, such as levamisole-tetramisole salts, formulated as gels and/or pastes, may be accurately and rapidly administered to farm animals (i.e., cattle) in predetermined doses by use of the feeding device of the invention. A multiple dose paste dispenser is described in U.S. Pat. No. 3,894,663 (1975).

Animal husbandry practices frequently involve the routine treatment of farm animals with drugs in order to minimize, prevent or cure infectious diseases of microbial origin, to combat infestation by parasites, or to promote animal growth. Such drugs usually are administered orally to animals as feed additives, or are dissolved in their drinking water, or given to animals as Oblets®, tablets, boluses, capsules or other similar preparations. Though most of the above formulations offer certain advantages, they also suffer from potentially serious drawbacks.

For example, medications offered in the feed or drinking water of an animal may not be ingested in the required dosage if the animal under treatment consumes less feed and/or drinks less water than was expected. Tablets, Oblets®, capsules and the like allow a more precise metering of medications, but doses are usually large. As a result, it is not easy to adjust doses to suit the animal's weight. These materials are also more time consuming and more difficult to administer to animals. Pour-ons, while easily administered, represent a rather inaccurate method for the delivery of feeds, drugs or other medicants. Injectables are well suited for the delivery of precise dosages of medications, but they may be difficult to administer and may cause tissue damage at the site of the injection.

In view of the foregoing summary of some demands and limitations of conventional materials and methods for delivering various feeds, drugs or other materials to farm animals, an improved method or device for accomplishing such objectives is highly desirable. An object of this invention is to provide a new and useful device which can be used for the rapid and accurate oral administration of various preparations of feeds, drugs or other medicinals to farm animals. This object is manifest in the following description and particularly delineated in the appended claims.

It has been discovered that by using the feeding device of the present invention, (c.f., FIG. 1), a desired material formulated as a gel or as a paste, may be administered with great ease and precision to animals with minimal or no discomfort. That the feeding device of the present invention and its method of operation may be more thoroughly explained and illustrated, the following detailed description is given.

The invention is hereinafter described with reference to the accompanying drawing in which:

FIG. 1 is a diagram of an animal-feeding device; and

Figure 2:
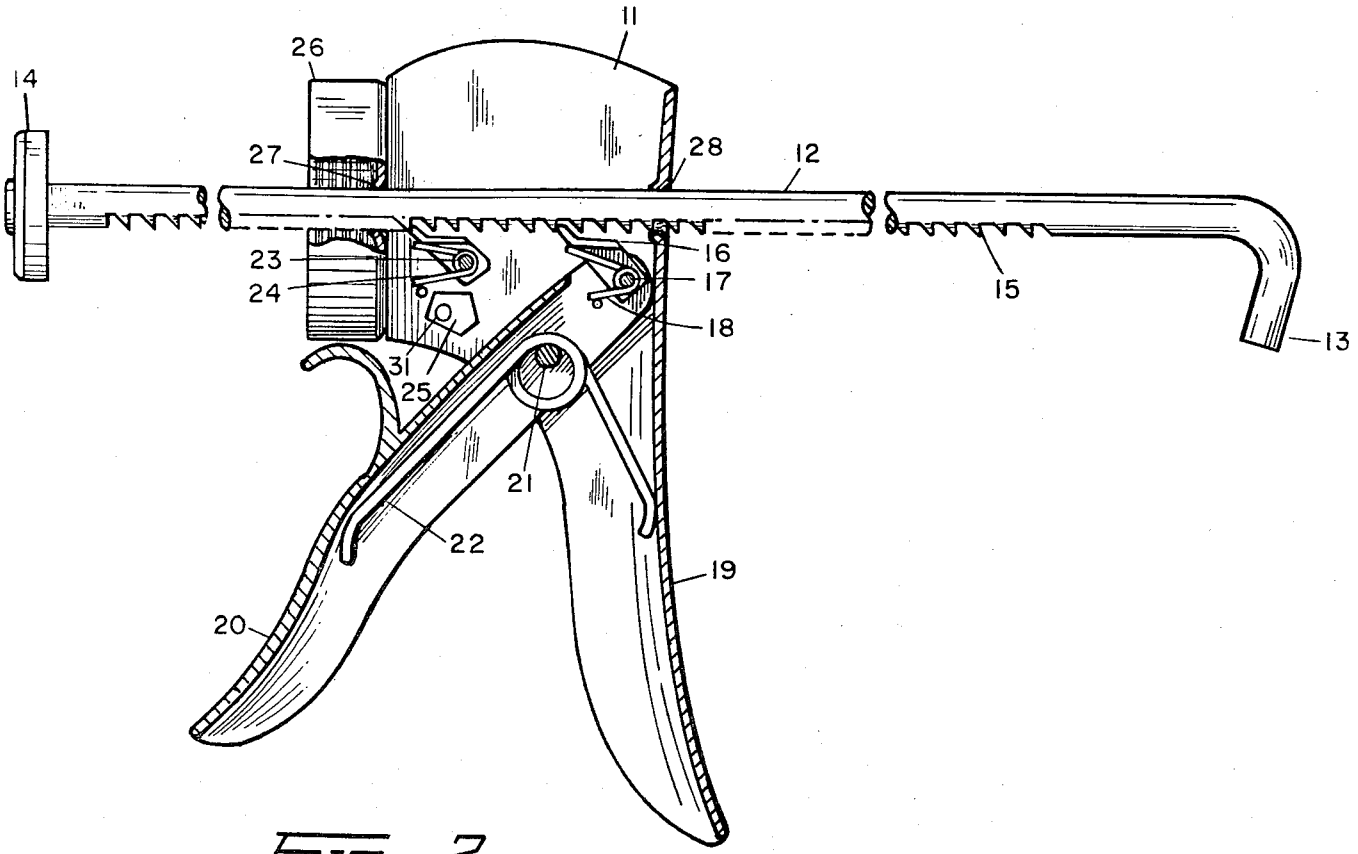

FIG. 2 presents a longitudinal section of this animal-feeding device.

Conveniently, a cartridge acting as a feed reservoir and containing enough material (i.e., medicated gel or paste) to deliver a plurality of doses is attached to the feeding device (FIG. 1) via a bayonet mount affixed to an internally threaded cup (26) (cartridge and bayonet mount are not shown). Prior to use, the dose is set by aligning the selected dose indicating number located on the dose setting knob (29) with the dose-indicating arrow (30). The dose setting convex polygonal cam (FIG. 2, No. 25) is thus set simultaneously for the appropriate dose since it is affixed to, and co-rotates with, the shaft of the dose-setting knob (29). The tip of the cartridge is then inserted into the side of the animal's mouth between its teeth, and the movable handle (20) is pulled back against the stationary handle (19) until the movable handle (20) comes to a full stop and the required dose of feed material is discharged into the animal's mouth.

Turning now to FIG. 2, an animal-feeding device is shown comprising: a housing (11), a stationary handle (19), and an internally threaded cup (26) which together form one integral unit, shaped so as to accept and enclose a dose-setting-convex-polygonal cam (25) having from four to seven and preferably five sides. The number of sides of the cam correspond to the doses the device is capable of delivering. The feed doses increase in proportion to the decreased distances from the sides of the polygonal cam to the rotational center of same. The cam (25) is attached to and rotatable around the shaft (31) of the dose-setting knob (29). The shaft (31) is supported by bearings (not shown) and emerges through one side of the housing (11) and is terminated in the dose- setting knob (29). The aforesaid polygonal cam (25), shaft (31), and dosage setting knob (29) form one integral unit, held in place at the selected setting by a spring (not shown). A set of numbers corresponding to the individual doses the feeding device is capable of delivering are marked on the dose-setting knob (29) affixed to, and rotatable around the shaft (31), so as to allow the alignment of the dose-indicating numbers with the dose-indicating arrow (30). The movable handle (20) is attached to the housing (11) via the movable handle shaft (21), and is held under tension away from the stationary handle (19), and held against the side of the convex polygonal cam (25) corresponding to the dose selected, by the main spring (22). A pawl (16) is attached to the movable handle (20) via a pawl shaft (17), and held against a ratchet (15) by a pawl spring (18). The ratchet (15) comprises a plurality of inclined teeth cut into it and being transverse to the longitudinal axis of a plunger-rod (12). The plunger-rod (12) coincides with the longitudinal axis of the housing (11), emerges through and is supported by front (27) and rear (28) bearings. The front end of the rod (12) terminates in a plunger (14), while the rear end of said rod is shaped to form a handle (13). An arresting pawl (23) pivots around a shaft (not shown), and is held against a ratchet (15) by a pawl spring (24), and serves to prevent the backward motion of the plunger (14) and the plunger-rod (12) while the feeding device is being used to treat farm animals.

Prior to use a compressible ring-shaped gasket is placed on the bottom of the internally threaded cup (26)

and a cartridge bayonet mount (not shown) is screwed into the cup (26) until firmly seated against the gasket.

Next, the unit comprising: plunger (14), plunger-rod (12), handle (13) and ratchet (15) is rotated around its longitudinal axis until the ratchet (15) is disengaged from the pawls (16 and 23). The unit is then pulled back and rotated again to reengage the ratchet (15) and pawls (16 and 23). A cartridge (not shown), holding a plurality of doses of the desired feed (i.e., a medicated gel or paste) is then affixed to the feeding device via the above-mentioned bayonet mount.

The required dosage is then set by rotating the dose-setting knob (29) until the dose number selected is aligned opposite the dose-indicating arrow (30), wherein this rotation is transferred by shaft (31) to the cam (25) so as to bring the appropriate side of the convex polygon in position to limit the forward motion of the movable handle (20). This procedure effects the dose delivery cycle and the size of the dose to be delivered.

The animal-feeding device (FIGS. 1 and 2) is thus loaded and set. The nozzle of the cartridge is then inserted into the side of the animal's mouth between its teeth, and the movable handle (20) is pivoted around the shaft (21) towards the stationary handle (19), as by squeezing, while the main spring (22) is simultaneously compressed. As the movable handle (21) pivots around the shaft (21), this swing is translated by the pawl (16) into a linear forward motion. Since the pawl (16) is held against the ratchet (15) by the spring (18), this forward motion is simultaneously transmitted by the pawl (16) to the ratchet (15), resulting in the forward motion of the plunger-rod (12) and plunger (14) attached thereto. As the plunger (14) moves forward it pushes ahead of itself a piston-seal which is built into the feed-containing cartridge, and as a result the forward movement of the piston-seal forces the corresponding volume of gel or paste through the nozzle of the cartridge and into the animal's mouth. The delivery of the dosage is completed when the movable handle (29) abuts against the stationary handle (19) and the motion of same around the shaft (21) is thereby arrested. When the movable handle (20) is released at the end of a cycle the compressed main spring (22) returns same to the starting position as determined by the setting of the cam (25). The feeding device is now ready for the delivery of another similar dose, or if cam (25) is reset, for the delivery of a dose of a different unit. The volume of the gel or paste delivered is determined by the inner diameter of the cartridge (constant) and the length of travel of the plunger (14). The length of travel of the plunger (14) is dependent on the angle through which the movable handle (20) pivots around the shaft (21) and the magnitude of this angle is dependent on the setting of the convex polygonal cam (25).

FIG. 2 shows the feeding device in the starting position with the cam (25) set at the maximum dose while FIG. 1 shows the corresponding dose number (i.e., 5) aligned with the dose-indicating arrow (30). The numbers 1 to 5 shown on FIG. 1 on the dose setting knob (29) correspond to the doses the device is capable of delivering. The size of the dosages increases in relation to increases of the dose-setting numbers (i.e., from 1 to 5).

What is claimed is:

1. An animal-feeding device for orally delivering a plurality of measured doses of gels, pastes or other similar preparations, which may be medicated, comprising: a housing, an externally-attached feed-containing cartridge, an injecting means, a propelling means, and an adjustable dose regulator, wherein said injecting means comprises a plunger-rod supported by bearings where said plunger-rod enters and exits said housing or makes contact therewith, and having a plurality of inclined teeth which traverse the plunger-rod along a longitudinal surface and serve as a ratchet, and the front end of said plunger-rod is terminated by a plunger which fits into said feed cartridge while the rear end of said plunger-rod forms a handle, and said plunger-rod passes through said housing and is freely rotatable and movable therethrough, and said plunger-rod is powered by said propelling means; wherein said propelling means comprises a handle pivotally-attached to said stationary handle of said housing, a spring traversing said pivotal attachment locus with one portion of said spring contacting said pivotally-attached handle while another portion of said spring contacts said stationary handle, and said pivotally-attached handle contains a pivotally-attached pawl which contacts said plunger rod or said ratchet of said plunger-rod, and a pawl spring which traverses said pivotal attachment locus of said pawl and one portion of said pawl spring contacts said pivotally-attached handle while another portion of said pawl spring contacts said pawl, and a housing-mounted pivotally-attached pawl located anterior to said pawl of said pivotally-attached handle and said housing-pawl contacts said plunger-rod or said ratchet of said plunger-rod and has a housing-pawl spring which traverses said pivotal attachment locus of said housing pawl and one portion of said housing-pawl spring contacts said housing at a stationary location while another portion of said housing-pawl spring contacts said housing-pawl; wherein said adjustable regulator comprises a pivotally-attached convex polygonal cam having from four to seven sides and an adjusting knob firmly attached to said pivot whereby said polygonal cam regulates said feeding device by selectively regulating said propelling means thereby affecting said injecting means.

2. An animal-feeding device according to claim 1 wherein said injecting means comprises a plunger-rod having a plurality of inclined teeth which traverse the rod along a longitudinal surface and serve as a ratchet, and the front end of said plunger-rod is terminated by a plunger which fits into said feed cartridge while the rear end of said plunger-rod forms a handle; said plunger-rod passes through said housing and is freely rotatable and movable therethrough; said plunger-rod is powered by said propelling means.

3. An animal-feeding device according to claim 2 wherein said plunger-rod of said injecting means is supported by bearings where said plunger-rod enters and exits said housing or makes contact therewith.

4. An animal-feeding device according to claim 1 wherein said housing has an internally-threaded cartridge-accepting cup and a stationary handle, and said housing accepts the propelling means, injecting means, and adjustable regulator.

5. An animal-feeding device according to claim 1 wherein said feed-containing cartridge is a tubular structurewith one attenuated end forming a nozzle and the other end of said cartridge has ridges for attachment to said internally-threaded housing cup by an externally-threaded bayonet mount.

* * * * *